US006962398B2

(12) United States Patent
Okuda et al.

(10) Patent No.: US 6,962,398 B2
(45) Date of Patent: Nov. 8, 2005

(54) METHOD FOR DRIVING INK JET RECORDING HEAD AND INK JET RECORDER

(75) Inventors: Masakazu Okuda, Tokyo (JP); Tomohiro Wada, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 122 days.

(21) Appl. No.: 10/296,284

(22) PCT Filed: May 22, 2001

(86) PCT No.: PCT/JP01/04275

§ 371 (c)(1),
(2), (4) Date: Nov. 22, 2002

(87) PCT Pub. No.: WO01/89841

PCT Pub. Date: Nov. 29, 2001

(65) Prior Publication Data

US 2003/0107617 A1 Jun. 12, 2003

(30) Foreign Application Priority Data

May 24, 2000 (JP) ..... 2000-157978

(51) Int. Cl.[7] ..... B41J 29/38
(52) U.S. Cl. ..... 347/10
(58) Field of Search ..... 347/9, 10, 11

(56) References Cited

U.S. PATENT DOCUMENTS 4,625,221 A * 11/1986 Mizuno et al. ..... 347/9

FOREIGN PATENT DOCUMENTS

| | | | |
|---|---|---|---|
| EP | 1123806 A1 * | 8/2001 | ..... B41J/2/045 |
| JP | 53-12138 | 4/1978 | |
| JP | 08-174823 | 7/1996 | |
| JP | 2593940 | 12/1996 | |
| JP | 10-114063 | 5/1998 | |
| JP | 10-193587 | 7/1998 | |
| JP | 11-157064 | 6/1999 | |
| WO | WO 00/23278 | 4/2000 | |
| WO | WO 00/26032 | 5/2000 | |

* cited by examiner

*Primary Examiner*—Stephen Meier
*Assistant Examiner*—Blaise Mouttet
(74) *Attorney, Agent, or Firm*—McGinn & Gibb, PLLC

(57) ABSTRACT

A method of driving an ink jet recording head, and an ink jet recording apparatus. A driving wave form for driving a piezoelectric actuator includes a first voltage changing process to compress a pressure generating chamber with a rise time of $t_1$, and a second voltage changing process to expand the pressure generating chamber with a fall time of $t_3$ after the voltage is maintained during a time of $t_2$. The start time, the voltage changing time, and the voltage variation of the second voltage changing process are set so that, in a room temperature environment, a first peak value $v_1$ and a second peak value $v_1$ of particle velocity generated at the nozzle section satisfy the condition: $0.3 \leqq v_2/v_1 \leqq 0.6$.

14 Claims, 14 Drawing Sheets

METHOD FOR DRIVING INK JET RECORDING HEAD AND INK JET RECORDER

TECHNICAL FIELD

The present invention relates to a driving method of an ink jet recording head and an ink jet recording apparatus for recording characters and images by discharging ink droplets from a nozzle.

BACKGROUND

Conventionally, as a drop-on-demand type ink jet wherein ink droplets are discharged from a nozzle connected to a pressure generating chamber which is filled with ink by producing pressure wave (acoustic wave) therein using an electromechanical transducer such as a piezoelectric actuator, examples described in Japanese Patent Publication No. SHO53-12138 and Japanese Patent Application Laid-Open No. HEI10-193587 have been generally known.

FIG. 11 is a diagram showing an example of a constitution of a recording head in the ink jet recording apparatus disclosed in the above publications. A pressure generating chamber 111 is connected with an ink supply channel 114 for conducting ink from an ink tank, which is not illustrated, via a nozzle 112 for ejecting ink and a common ink chamber 113.

Besides, the pressure generating chamber 111 is provided with a diaphragm 115 on the bottom surface thereof. On the occasion of discharging an ink droplet, pressure wave is produced in the pressure generating chamber 111 by displacing the diaphragm 115 using a piezoelectric actuator 116 installed outside of the pressure generating chamber 111 so that a volume change occurs in the pressure generating chamber 111. By the pressure wave, the ink filling the pressure generating chamber 111 is partially discharged out via the nozzle 112, and flies as an ink droplet 117. The flying ink droplet 117 lands on a recording medium such as recording paper and forms a recording dot. Characters and images are recorded on the recording paper by repeatedly executing such formation of the recording dot based on image data.

Various shapes of driving waveforms are applied to the piezoelectric actuator 116 corresponding to the sizes of the ink droplets to be ejected, however, in the case of discharging a large-diameter ink droplet used for recording characters or a dense part, the driving waveform as shown in FIG. 12(*a*) is adopted in general.

That is, in voltage changing process 121, the ink droplet is discharged by increasing voltage applied to the piezoelectric actuator 116 and so rapidly decreasing the volume of the pressure generating chamber 111, and after that, the voltage is returned to standard voltage ($V_b$) in voltage changing process 122.

Incidentally, a relationship between driving voltage and the operation of the piezoelectric actuator 116 varies depending on the constitution of the piezoelectric actuator 116 and/or polarization direction. In the present invention, it is assumed that when the driving voltage is increased, the volume of the pressure generating chamber 111 decreases, and contrary, when the driving voltage is decreased, the volume thereof increases.

In addition, a driving waveform as shown in FIG. 12(*b*) may be adopted in order to stabilize the flying condition of the ink droplet. In the waveform, voltage changing process 123' for slightly increasing the volume of the pressure generating chamber 111 is added just before voltage changing process 121' for ejecting the ink droplet, and the ejecting state of the ink droplet is stabilized by the operation of the added voltage changing process 123'. Namely, meniscus at an aperture of the nozzle is retracted to the side of the pressure generating chamber 111 by slightly expanding the pressure generating chamber 111 before ejection, and thereby the form of the meniscus just before the ejection becomes slightly concave.

When the ejection of the ink droplet is executed on such condition where the meniscus is in concave form, it is possible to reduce the influence of wet on the nozzle surface or nonuniform shape of the aperture of the nozzle (burr, etc.), and thus stabilize the ejecting direction of the ink droplet and occurrence condition of a satellite.

FIG. 13(*a*) shows a flying condition of an ink droplet on the occasion of ejecting the ink droplet by the driving waveform of FIG. 12(*a*). There is a tail 132 at the back of the ink droplet ejected from a nozzle aperture 131. The tail separates from a main drop 133 during the flying process, and forms a satellite 134. The satellite 134 becomes a spherical shape in the flying process, flying at a speed equal to or a little slower than the speed of the main drop, and reaches the recording paper.

FIG. 14(*a*) is a model diagram showing the condition of the meniscus just after ejecting a large ink droplet. After ejecting the ink droplet, a concave-shaped meniscus 142 is formed since the quantity of ink in a nozzle 141 decreases. The concave-shaped meniscus 142 gradually returns up to the aperture portion of the nozzle by the operation of surface tension of the ink, and recovers the condition before the ejection. Such recovery action of the meniscus is called "refill".

In the case of discharging ink droplets in succession, unless the following ejection is executed after the refill has been completed, the diameter and speed of the ink droplet will be destabilized and the steady successive ejection cannot be performed. That is, the maximum driving frequency of the ink jet recording head is subject to the speed of the refill. Accordingly, in the conventional ink jet recording head, the head has been designed to speed up the refill so that the recording speed (driving frequency) accelerates as fast as it can.

Concretely, the widths of the nozzle and the supply channel, the length and sectional area of the pressure generating chamber and so forth are designed so as to lessen fluid channel resistance (acoustic resistance) and inertance (inertia) in the ink fluid channel between the ink tank and nozzle.

However, with the ink jet recording head of these days improving in picture quality and speed, there have arisen the following problems which the conventional design of a driving waveform and a head is unable to cope with.

The first problem is that a satellite generated on the ejection of a large-diameter ink droplet (big drop) deteriorates picture quality. As described above, the satellite is generated when the big drop is discharged. If there was a wide gap between landing positions of the main drop and satellite, the picture quality will be notably deteriorated. Particularly, in the case where the diameter of the ink droplet is modulated in grades (drop diameter modulation) for printing out a gradation image such as a photograph in high quality, it is impossible to obtain the high-quality picture without controlling the landing position of the satellite precisely.

The deterioration in picture quality due to the error of the landing position of the satellite as above is remarkable especially when the environment temperature changes. FIGS. 13(*b*) and 13(*c*) are model diagrams showing changes in a flying condition due to the environment temperatures. In the case where a big drop was ejected adopting the driving waveform of the conventional example shown in FIG. 12(*a*), a normal flying condition as shown in FIG. 13(*a*) was obtained in a room temperature environment (25□) and a high temperature environment (40□), and there was no problem in a recording result.

However, when the recording was executed in a low temperature environment (5□), the tail of the ink droplet became extremely long as shown in FIG. 13(*c*), and it was observed that a low velocity satellite 136 was produced. Such low velocity satellite 136 lands onto recording paper in a floating condition, causing great deterioration in the sharpness of a whole image. In addition, the satellite stains a blank space of the image, and thereby picture quality is notably deteriorated.

Moreover, in the case where another conventional driving waveform was employed, while a normal flying condition as shown in FIG. 13(*a*) was obtained in the room temperature environment and low temperature environment, it was observed that a large number of fine particulate satellites 135 as shown in FIG. 13(*b*) were produced in the high temperature environment. Such fine particle satellites 135 easily stick onto the surface of a nozzle plate, causing deterioration in the ejecting direction of the drops during the successive ejection and an ejection failure.

As described above, in order to realize a good image recording at any time regardless of a change in the environment temperature, the satellite generated during the ejection of a big drop should be always maintained in a normal condition. However, there has been no established control method of the satellite, and therefore it has been very difficult to keep a satellite in good condition constantly in a wide range of temperature.

The second problem which the conventional design of a driving waveform and a head cannot cope with is the acceleration of the refill. As mentioned above, the speed of the refill needs to be accelerated for raising an ejection frequency of an ink droplet. For the sake of that, it is necessary to widen the nozzle, ink supply channel, a sectional area of the pressure generating chamber and the like to reduce the fluid resistance and inertance in the ink fluid channel. However, an increase in the diameter of the nozzle is a disadvantage in ejecting a fine ink droplet which is essential for recording a high quality picture, and therefore the diameter of the nozzle cannot be made wider than a certain width (about 35 $\mu$m is the upper limit in general).

Moreover, since a gain in the diameter of the ink supply channel causes deterioration in the efficiency of the ejection, it is also difficult to make it wider drastically. With regard to the pressure generating chamber, it is an advantage in accelerating the refill to widen the sectional area and shorten the length, however, since the shape of the pressure generating chamber has a close relationship with a resonance frequency of pressure wave and the density of the nozzles in rows, etc., there is little freedom of the shape, and it is difficult to gain the refill velocity drastically by a change in the shape of the pressure generating chamber.

Namely, in the conventional ink jet recording head, there has been a problem that it is difficult to increase the refill velocity to a large extent by improving a constitution of the head, and thus it is impossible to sufficiently meet a recent demand for improving the recording speed.

It is therefore an object of the present invention, which has been devised to solve the problems, to provide a driving method of an ink jet recording head and an ink jet recording apparatus suitable for a high frequency driving, which are capable of accelerating refill velocity after the ejection of a big ink droplet as well as recording image with high quality at any time regardless of a change in environment temperature by flying a satellite on ejecting the big drop in good condition constantly.

SUMMARY OF THE INVENTION

To attain the above object, the invention provides a driving method of an ink jet recording head, transforming an electromechanical transducer by applying driving voltage thereto for producing a pressure change in a pressure generating chamber filled with ink so that an ink droplet is discharged from a nozzle connected to the pressure generating chamber, wherein a voltage waveform of the driving voltage comprises at least a first voltage changing process for compressing the volume of the pressure generating chamber to discharge an ink droplet and a second voltage changing process for expanding the volume of the pressure generating chamber, besides, a start time, voltage changing time and voltage variation of the second voltage changing process are set so that, in a room temperature environment, a first peak value $v_1$ and a second peak value $V_2$ of particle velocity generated at the nozzle section satisfy the following condition.

$$0.3\square v_2/v_1\square 0.6$$

The invention further is a driving method of an ink jet recording head in which a voltage changing time of the first voltage changing process is set to substantially ½ of a resonance period of pressure wave generated in the pressure generating chamber.

The invention also is a driving method of an ink jet recording head in which a time interval between a finish time of the first voltage changing process and the start time of the second voltage changing process is set to approximately ½ of the resonance period of the pressure wave.

The invention additionally is a driving method of an ink jet recording head in which the voltage changing time of the second voltage changing process is set to ½ or more than ½ of the resonance period of the pressure wave.

The invention further provides an ink jet recording apparatus for recording characters and images using an ink jet recording head, transforming an electromechanical transducer by applying driving voltage thereto for producing a pressure change in a pressure generating chamber filled with ink so that an ink droplet is discharged from a nozzle connected to the pressure generating chamber, wherein a voltage waveform of the driving voltage comprises at least a first voltage changing process for compressing the volume of the pressure generating chamber to discharge the ink droplet and a second voltage changing process for expanding the volume of the pressure generating chamber, besides, a start time, voltage changing time and voltage variation of the second voltage changing process are set so that, in a room temperature environment, a first peak value $v_1$ and a second peak value $v_2$ of particle velocity generated at the nozzle section satisfy the following condition.

$$0.3\square v_2/v_1\square 0.6$$

The invention also is an ink jet recording apparatus in which a voltage changing time of the first voltage changing process is set to approximately ½ of a resonance period of pressure wave generated in the pressure generating chamber.

The invention additionally is an ink jet recording apparatus in which a time interval between a finish time of the first voltage changing process and the start time of the second voltage changing process is set to approximately ½ of the resonance period of the pressure wave.

The invention still further is an ink jet recording apparatus in which the voltage changing time of the second voltage changing process is set to ½ or more than ½ of the resonance period of the pressure wave.

The invention also is an ink jet recording apparatus in which the electromechanical transducer includes a piezoelectric vibrator.

In accordance with the present invention, there is provided a driving method of an ink jet recording head and an ink jet recording apparatus, which transform an electromechanical transducer by applying driving voltage thereto for producing a pressure change in a pressure generating chamber filled with ink so that an ink droplet is discharged from a nozzle connected to the pressure generating chamber, wherein a voltage waveform of the driving voltage comprises at least a first voltage changing process for compressing the volume of the pressure generating chamber to discharge the ink droplet and a second voltage changing process for expanding the volume of the pressure generating chamber, and the start time, voltage changing time and voltage variation of the second voltage changing process are set so that, in a room temperature environment, a first peak value $V_1$ and a second peak value $V_2$ of particle velocity generated at the nozzle section satisfy the following condition.

$$0.3 \square v_2/v_1 \square 0.6$$

Namely, in the conventional driving method of an ink jet recording head and ink jet recording apparatus, the operation of pressure wave residual oscillation after ejecting a big ink droplet has not been fully elucidated, and a residual oscillation control section for a driving waveform has not been set appropriately. On the other hand, the present inventors found out based on a large number of experiments and observations on the ink ejection that it is possible to accelerate refill velocity as well as optimizing a flying condition of a satellite by setting the residual oscillation just after ejecting a big drop to meet a certain condition. Thereby, picture quality and recording speed (driving frequency) can be improved without changing the constitution of a head.

BEST MODE FOR CARRYING OUT THE INVENTION

Figure 1:
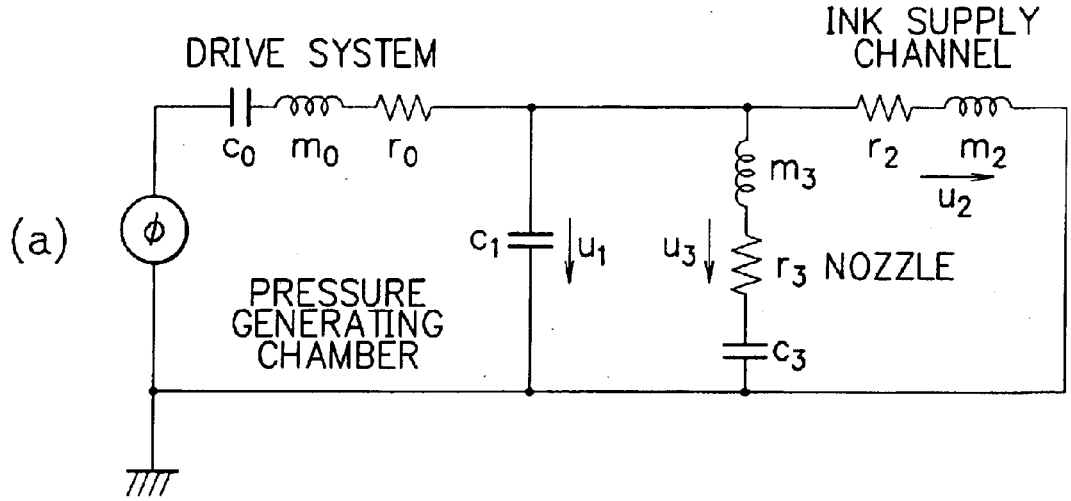
FIGS. 1(*a*) and 1(*b*) are diagrams showing an equivalent electric circuit of an ink jet recording head.
Figure 1:
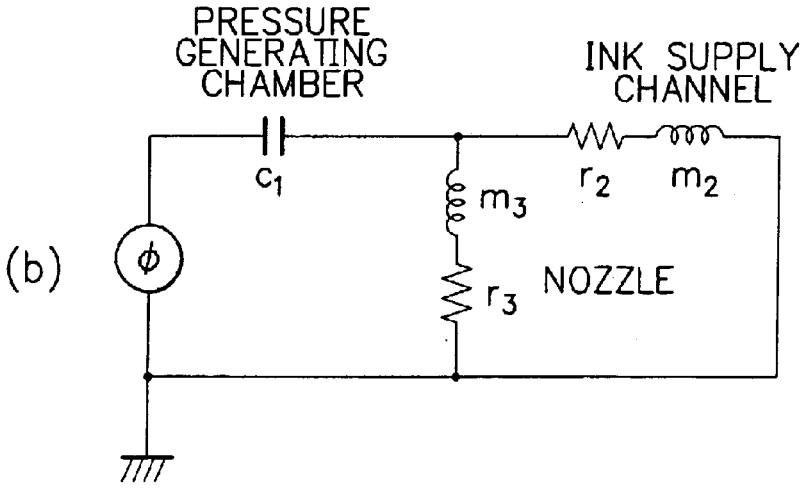

Referring now to the drawings, a description of preferred embodiments of a driving method of an ink jet recording head and an ink jet recording apparatus according to the present invention will be given in detail.

First, the principle and operation of the present invention described above will be explained based on a result of theoretical analysis of the ink jet recording head employ ing a lumped parameter circuit model.

Figure 11:
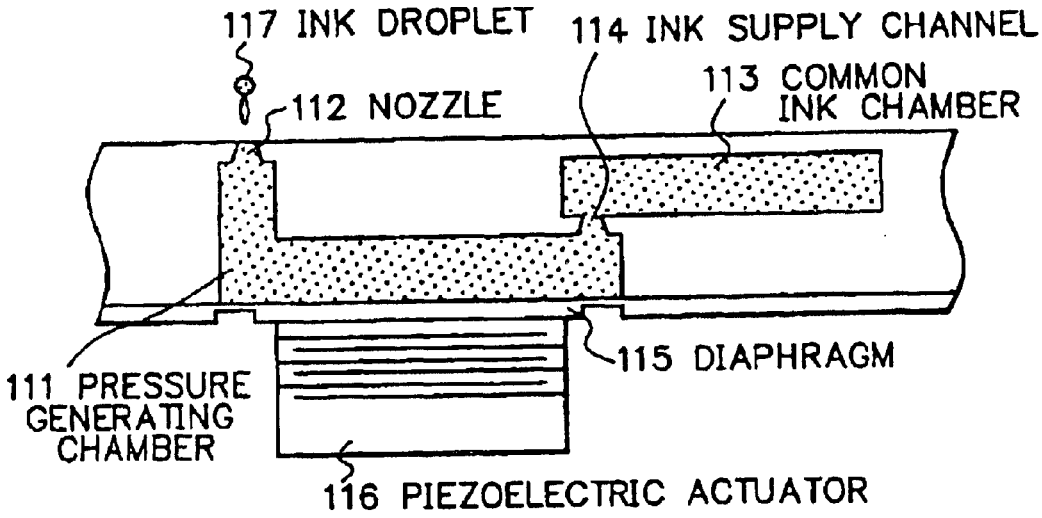
F I G. 11 (BACKGROUND ART)
FIG. 11 is a sectional diagram showing a basic constitution of an ink jet recording head.
Figure 12:
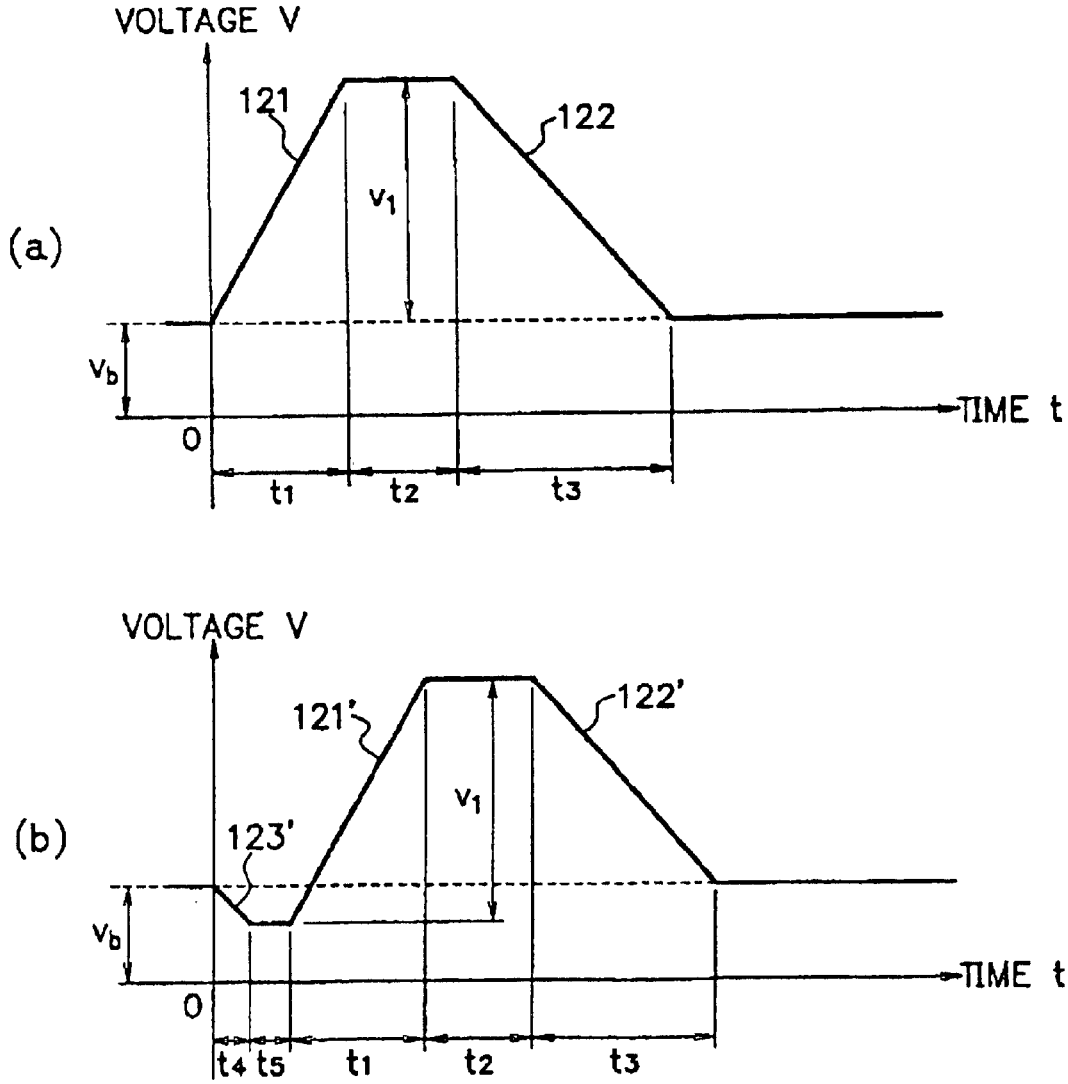
F I G. 12 (BACKGROUND ART)
FIGS. 12(*a*), 12(*b*), a nd 12(*c*) a re diagrams showing an example of a conventional driving waveform.

FIG. 1(*a*) is a circuit diagram which illustrates an ink jet recording head of FIG. 11 with an equivalent electric circuit showing. Here, "m" denotes inertance [kg/m$^4$], "r" denotes acoustic resistance [Ns/m$^5$], "c" denotes acoustic capacitance [m$^5$/N], "u" denotes volume velocity [m$^3$/s] and "φ" denotes pressure [Pa]. Besides, subscripts "1", "2" and "3" denote a driving section, a pressure generating chamber, an ink supply channel and a nozzle, respectively.

In the case of employing a high-rigidity laminated piezoelectric actuator as a piezoelectric actuator in the circuit of FIG. 1(*a*), the inertance $m_0$, acoustic resistance $r_0$ and acoustic capacitance co in a vibration system can be disregarded. Moreover, the acoustic capacitance $c_3$ of the nozzle can also be disregarded at the time of analyzing pressure wave and thus the circuit shown in FIG. 1(*b*) is able to approximate to the circuit of FIG. 1(*a*).

Figure 2:
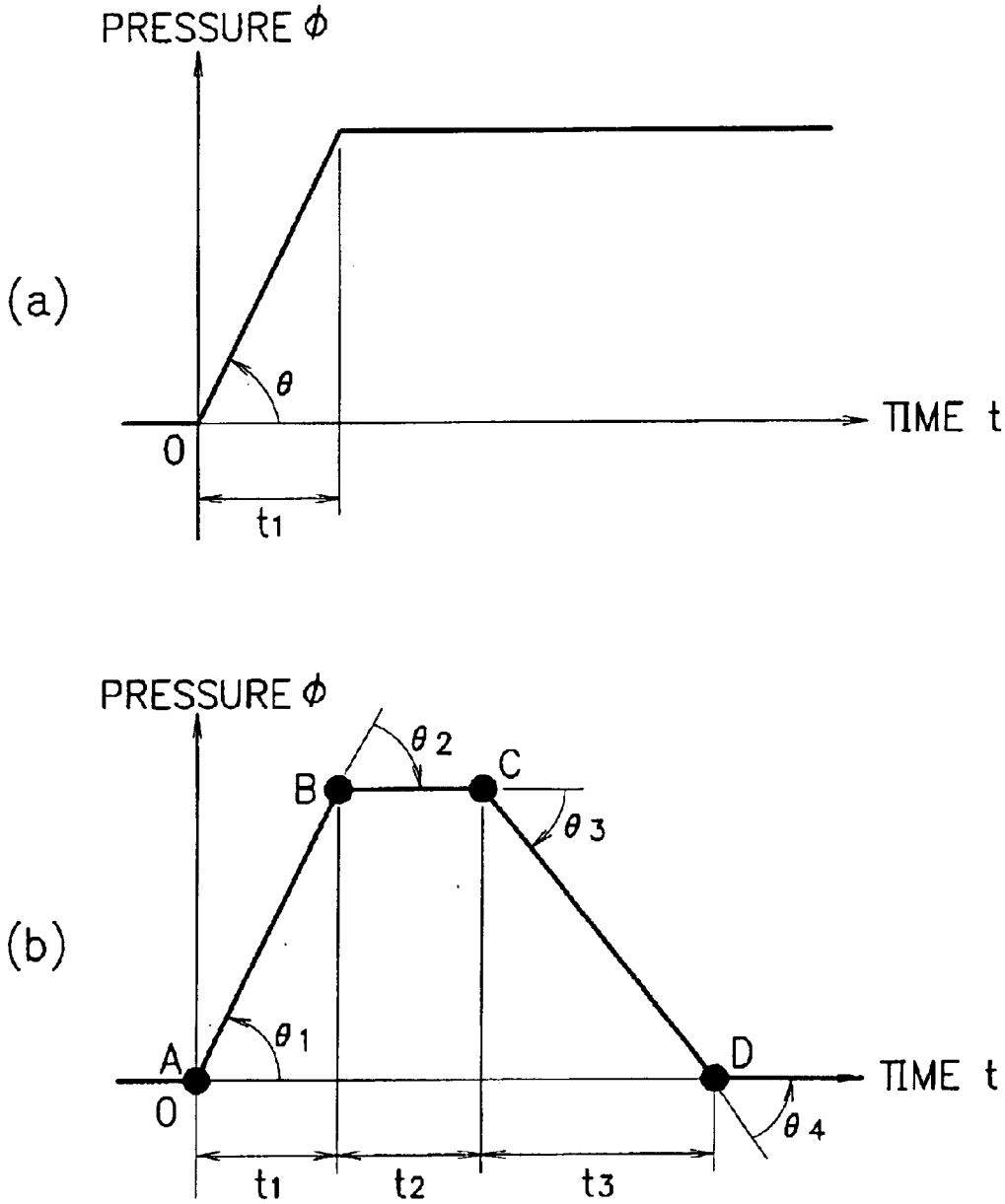
FIGS. 2(*a*) and 2(*b*) are first diagrams for explaining a relationship between a driving waveform and particle velocity at a nozzle section.

Assuming that the inertance and acoustic resistance of the nozzle and ink supply channel obtain the following relation: $m_2=k\cdot m_3$; $r_2=k\cdot r_3$, in a circuit analysis with respect to the case where a driving waveform having a rising angle θ as shown in FIG. 2(*a*) is input, particle velocity $v_3'$ at the nozzle section in a period of time: $0 \square t \square t_1$ is expressed as the following equations ($A_3$ denotes an area of an aperture of the nozzle).

$$v_3'(t,\theta) = \frac{c_1\tan\theta}{A_3\left[1+\frac{1}{k}\right]}\left[1-\frac{w}{E_c}\exp(-D_c\square E)\sin(E_c\square E-\phi_0)\right](0 \le t \le t_1) \quad (1)$$

$$E_c = \sqrt{\frac{1+\frac{1}{k}}{c_1 m_3} - D_c^2}$$

$$D_c = \frac{r_3}{2m_3}$$

$$w^2 = \frac{1+1/k}{c_1 m_3}$$

-continued $$\phi_0 = \tan^{-1}\left[\frac{E_c}{D_c}\right]$$

The particle velocity in the case where the driving waveform having a complicated shape as shown in FIG. 2(*b*) is employed can be obtained by putting together the particle velocity produced at each node of the driving waveform (A, B, C, D). That is, the particle velocity $v_3$ produced by the driving waveform of FIG. 2(*b*) is expressed as the following equations.

$$\left.\begin{aligned}
v_3(t) &= v_3'(t, \theta_1) && (0 \le t < t_1) \\
v_3(t) &= v_3'(t, \theta_1) + v_3'(t - t_1, \theta_2) && (t_1 \le t < t_1 + t_2) \\
v_3(t) &= v_3'(t, \theta_1) + v_3'(t - t_1, \theta_2) + v_3'(t - t_1 - t_2, \theta_3) && (t_1 + t_2 \le t < t_1 + t_2 + t_3) \\
v_3(t) &= v_3'(t, \theta_1) + v_3'(t - t_1, \theta_2) + v_3'(t - t_1 - t_2, \theta_3) + v_3'(t - t_1 - t_2 - t_3, \theta_4) && (t \ge t_1 + t_2 + t_3)
\end{aligned}\right\} \quad (2)$$

Figure 3:
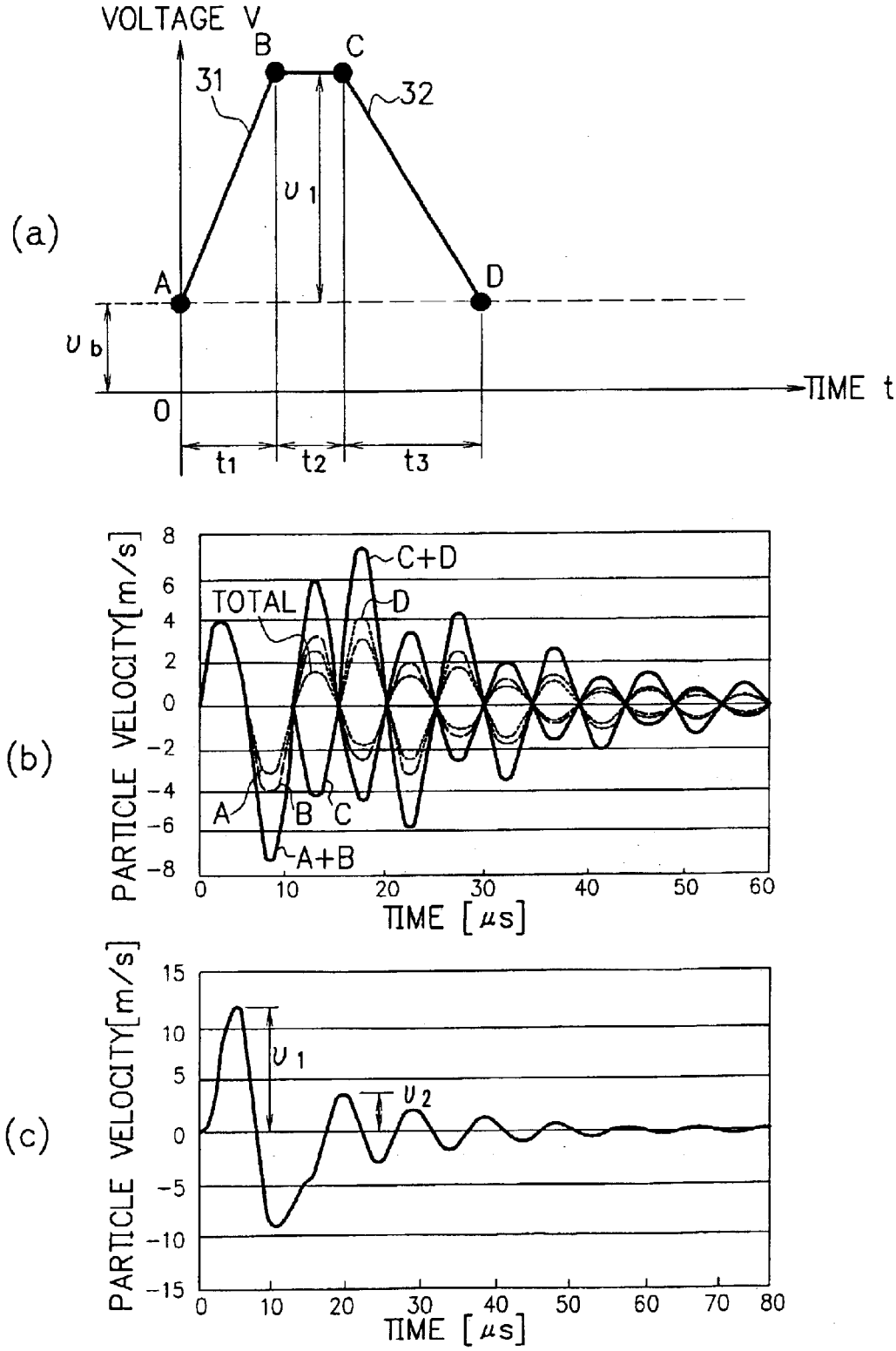
FIGS. 3(*a*), 3(*b*), and 3(*c*) are second diagrams for explaining a relationship between a driving waveform and particle velocity at a nozzle section.

FIG. 3 shows a result of calculation for finding the particle velocity $v_3$ using the above equation with respect to an example of the conventional driving waveform. The driving waveform of FIG. 3(*a*) comprises a first voltage changing process 31 and a second voltage changing process 32. Pressure wave is generated at four points: nodes A, B, C, and D. The timing of a voltage change and voltage changing time is expressed as follows: $t_1$=5 μs; $t_2$=5 μs; $t_3$=5 μs.

FIG. 3(*b*) shows a result of calculation for obtaining the particle velocity generated at the respective nodes of the driving waveform based on the equation (1) (taking only the vibration elements into consideration). Thin lines in the diagram indicate the particle velocity at the respective nodes A, B, C and D, and a bold line indicates the particle velocity of them put together. Besides, FIG. 3(*c*) shows a result of the calculation to obtain the particle velocity that is actually generated in the nozzle according to the equation (2).

A significant matter at this point is a relationship between composite wave A+B of the particle velocity generated at the nodes A and B constituting the first voltage changing process and composite wave C+D of the particle velocity generated at the nodes C and D (the node C alone when $t_3$ is large) constituting the second voltage changing process. In the conventional driving waveform shown here, since the composite waves A+B and C+D are almost equal in amplitude and differ in phase by 180° as is clear from FIG. 3(*b*), both of the composite waves counteract each other and thus residual oscillation is very small.

Figure 4:
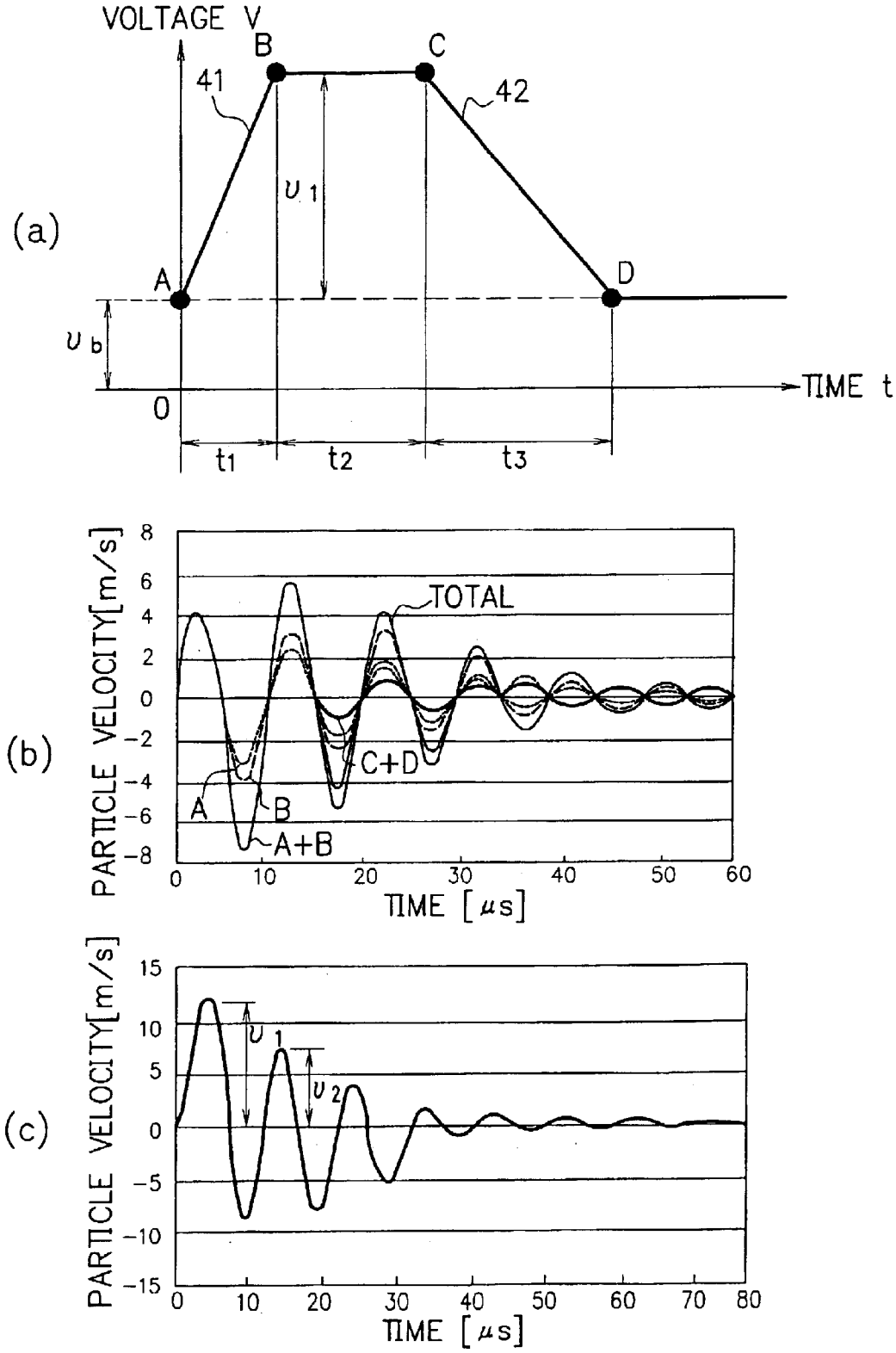
FIGS. 4(*a*), 4(*b*), and 4(*c*) are third diagrams for explaining a relationship between a driving waveform and particle velocity at a nozzle section.

On the other hand, in another conventional driving waveform shown in FIG. 4 ($t_1$=5 μs; $t_2$=10 μs; $t_3$=12 μs), timing of producing pressure at the node C is delayed and the phase difference of the composite wave A+B and that of C+D are the same, and therefore great residual oscillation remains. Thus the particle velocity (residual oscillation) generated just after the ejection greatly varies depending on the setting of the second voltage changing process.

The present inventors found out that there was a strong correlation between the magnitude of the particle velocity produced just after the ejection (residual oscillation intensity) and the occurrence condition of a satellite based on many ejection experiments and observations. Namely, it was made evident that when the residual oscillation after the ejection was very small as shown in FIG. 3, the tail of an ink droplet became long as shown in FIG. 13(*c*), and a low velocity satellite flew easily.

Figure 13:
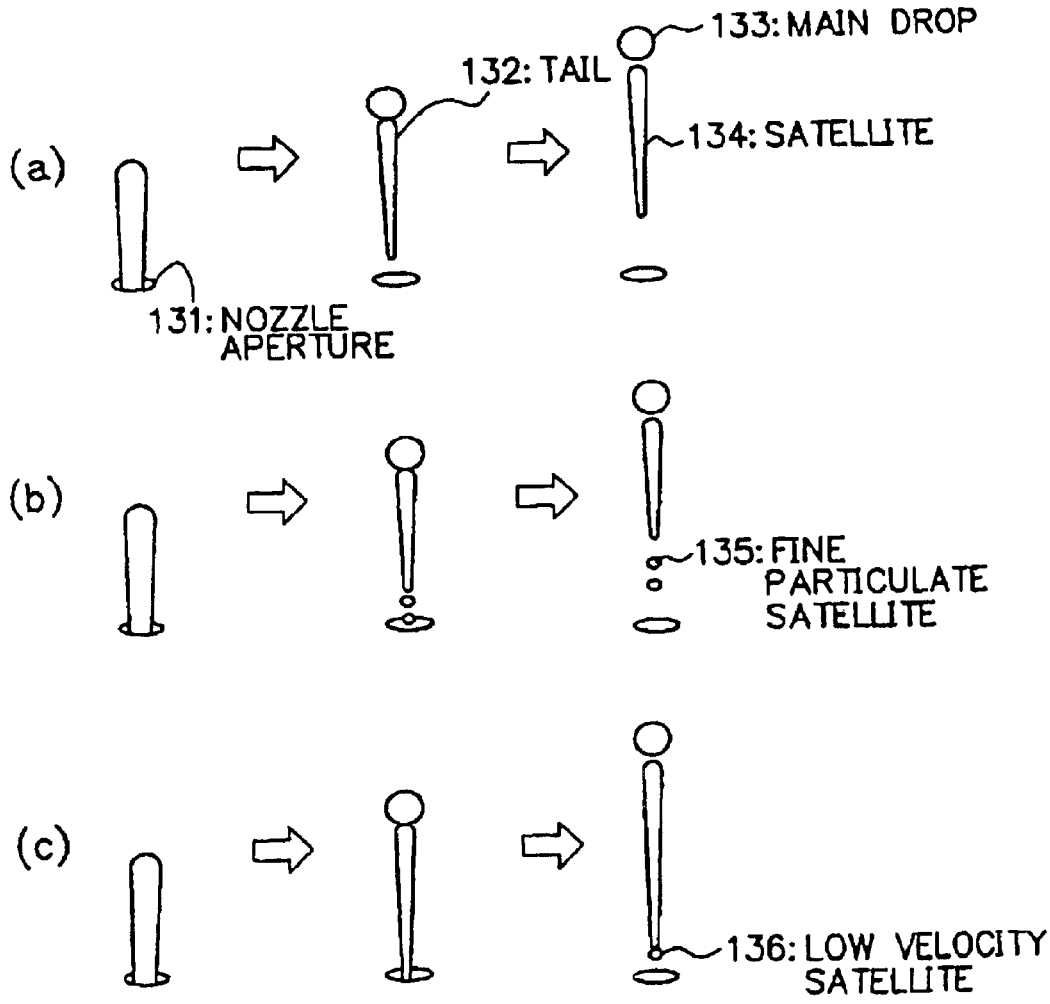
F I G. 13 (BACKGROUND ART)
FIGS. 13(*a*), 13(*b*), and 13(*c*) are diagrams for explaining a discharge condition of the ink droplet.

When the residual oscillation after the ejection was great as shown in FIG. 4 by contrast, it was observed that the tail of the ink droplet became short as shown in FIG. 13(*b*), and a fine satellite flew easily. In brief, there arose problems in either case where the residual oscillation just after the ejection was too big or too small, and a proper setting range was in existence. Further, it was made clear as a result of survey with respect to the proper setting range that the flying condition of the satellite was able to be stabilized in a wide range of environment temperature by obtaining the following relation between a first peak value $v_1$ and a second peak value $v_2$ of the particle velocity generated in the nozzle section (refer to FIGS. 3(*c*) and 4(*c*)).

$$0.3 \square v_2/v_1 \square 0.6 \quad (3)$$

Moreover, the present inventors also discovered that there was a strong correlation between the intensity of the residual oscillation after the ejection and the refill velocity. That is, when the residual oscillation after the ejection is very small as in FIG. 3, the refill is remarkably slow down, and on the other hand, when it is great as shown in FIG. 4, the refill is speeded up.

Figure 14:
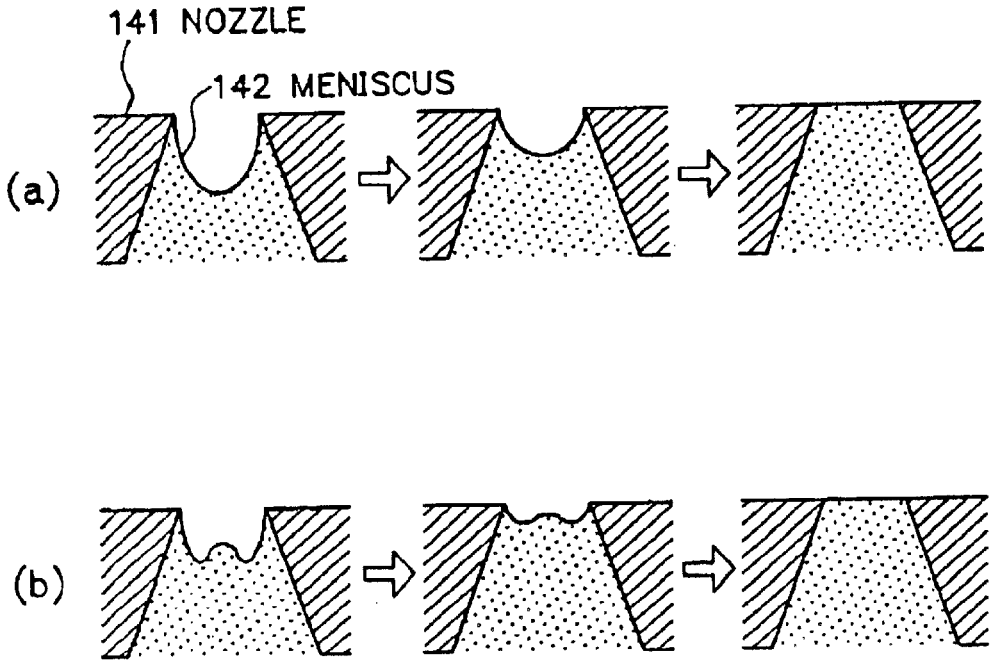
F I G. 14 (BACKGROUND ART)
FIGS. 14(*a*), 14(*b*), and 14(*c*) are diagrams for explaining the movement of a meniscus in refill operation.

Regarding the reason why the refill velocity is accelerated as the residual oscillation becomes more intense, an increase in capillary force generated in the meniscus is conceivable. That is, when the residual oscillation is small, the meniscus after ejecting a droplet gradually returns up to the aperture section of the nozzle with its shape kept approximate to a parabola as shown in FIG. 14(*a*). On the other hand, when the residual oscillation is intense, the shape of the meniscus becomes complicated as shown in FIG. 14(*b*). The capillary force acting on the meniscus depends on curvature radius of a liquid surface: the smaller the local curvature radius is as shown in FIG. 14(*b*), the stronger the capillary force becomes. Accordingly, it can be assumed that as the residual oscillation becomes more intense and the shape of the meniscus becomes further complicated, the capillary force acting on the meniscus becomes stronger and the refill velocity accelerates.

As above, the greater residual oscillation is preferable in terms of the refill velocity. However, there arises a problem that when the intensity of the residual oscillation goes beyond a certain bound, the time necessary to attenuate the residual oscillation is prolonged, and thus the ejection becomes unstable in its successive performance at a high frequency (this is remarkable at a high temperature in particular).

According to the experiments and observations on the ejection by the present inventors, it was verified that the ejection at a high temperature was liable to be unsteady on condition that $v_2/v_1$>0.65. Therefore, in terms of speeding up the refill velocity only, it is preferable that $v_2/v_1$ is set to about 0.5–0.6.

As described above, from two viewpoints as the flying condition of the satellite and acceleration of the refill, the residual oscillation after ejecting a big ink droplet had better be left within an adequate range. Concretely, it is important to obtain the relation of the equation (3) between the first peak value $V_1$ and second peak value $v_2$ of the particle velocity generated in the nozzle section.

In the embodiments of the present invention, the ink jet recording head has the same basic constitution as that of the conventional one shown in FIG. 11.

The ink jet recording head is made by laminating and bonding a plurality of thin plates, which are pierced by etching etc., with adhesive. In the present embodiments, stainless plates in 50–75 μm thickness are bonded together adopting an adhesive layer (about 5 μm thickness) of thermosetting resin.

The ink jet recording head is provided with a plurality of pressure generating chambers 111 (disposed in a vertical direction in FIG. 11), which are connected with each other by a common ink camber 113. The common ink chamber 113 is connected to an ink tank (not shown), conducting ink to each pressure generating chamber 111.

The pressure generating chambers 111 are connected to the common ink chamber 113 via an ink supply channel 114, and filled with ink. Each of the pressure generating chambers 111 is provided with a nozzle 112 for discharging the ink.

In the present embodiment, the nozzle 112 and ink supply channel 114 are in the same shape, that is, in the taper shape with an aperture diameter 30 μm, a bottom diameter 65 μm and a length 75 μm. The piercing is implemented by a press.

A diaphragm 115 is provided at the bottom of the pressure generating chamber 111, and it is made possible to compress (deflate) or expand (inflate) the pressure generating chamber 111 by a piezoelectric actuator (piezoelectric vibrator) 116 as an electromechanical transducer, which is placed outside the pressure generating chamber 111. In the present embodiments, a nickel thin plate formed by electroforming is used as the diaphragm 115.

Laminated piezoelectric ceramics are employed for the piezoelectric actuator 116. By producing a volume change in the pressure generating chamber 111 using the piezoelectric actuator 116, pressure wave is generated therein. Ink in the nozzle 112 is activated by the pressure wave, and discharged outside from the nozzle 112. Thereby, an ink droplet 117 is formed. Incidentally, a resonance period $T_c$ of the head adopted in the present embodiments is 10 μs. Besides, although the value of the resonance period $T_c$ is not limited to the above value, it is preferable to set it within a range from 7 to 15 □ considering the drop velocity of a big drop and ejection characteristic of a small drop.

Next, a basic constitution of a driving circuit for driving the piezoelectric actuator will be described referring to FIGS. 5 and 6.

Figure 5:
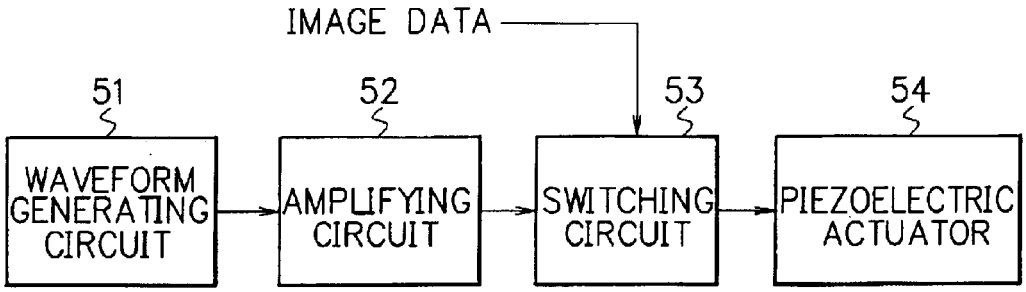
FIG. 5 is a block diagram showing a constitution of a driving circuit of the ink jet recording head.

FIG. 5 shows an example of the driving circuit in the case where a diameter of an ink droplet to be discharged is fixed (a drop diameter modulation is not executed). The driving circuit of the example produces a driving waveform signal to amplify electric power, supplies it to the piezoelectric actuator, and thus drives the piezoelectric actuator for printing characters and images on recording paper. As shown in FIG. 5, the driving circuit includes at least a driving waveform generating circuit 51, an amplifying circuit 52, a switching circuit (a transfer gate circuit) 53 and a piezoelectric actuator 54.

The driving waveform generating circuit 51, which comprises a digital/analog conversion circuit and an integrating circuit, executes analog conversion to driving waveform data by the digital/analog conversion circuit, and then integral-processes the data by the integrating circuit to produce a driving waveform signal.

The amplifying circuit 52 amplifies voltage and electric current of the driving waveform signal supplied from the waveform generating circuit 61 and outputs it as an amplified driving waveform signal.

The switching circuit 53, which executes on/off control of the ink droplet ejection, applies the driving waveform signal to the piezoelectric actuator 64 based on a signal produced from image data.

Figure 6:
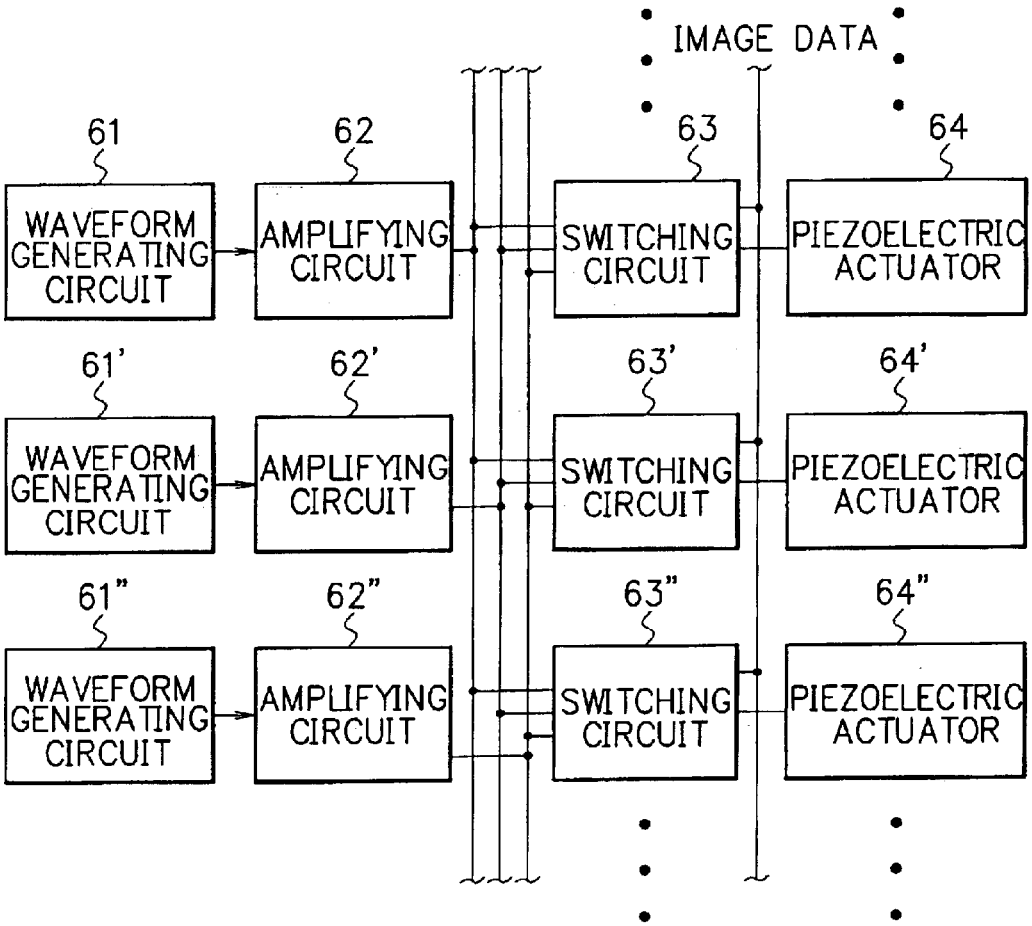
FIG. 6 is a block diagram showing another constitution of the driving circuit of the inkjet recording head.

FIG. 6 shows a basic constitution of the driving circuit in the case where the diameters of ink droplets to be ejected are switched into many grades, i.e. a drop diameter modulation is performed. In order to modulate the ink droplets into three grades (the big drop, medium drop and small drop), the driving circuit in this example comprises three types of waveform generating circuits 61, 61', 61", each of which corresponds to respective drop diameters. Each waveform is amplified by the amplifying circuits 62, 62', and 62". On the occasion of recording, the driving waveform, which is applied to the piezoelectric actuator (64, 64', 64", . . . ), is switched by the switching circuit (63, 63', 63", . . . ) based on the image data, and an ink droplet having desired diameter is ejected. Incidentally, the driving circuit for driving the piezoelectric actuator is not restricted to the one having the constitution described in the present embodiments, it is possible to employ the driving circuits of the other constitution.

□First Embodiment□

Figure 7:
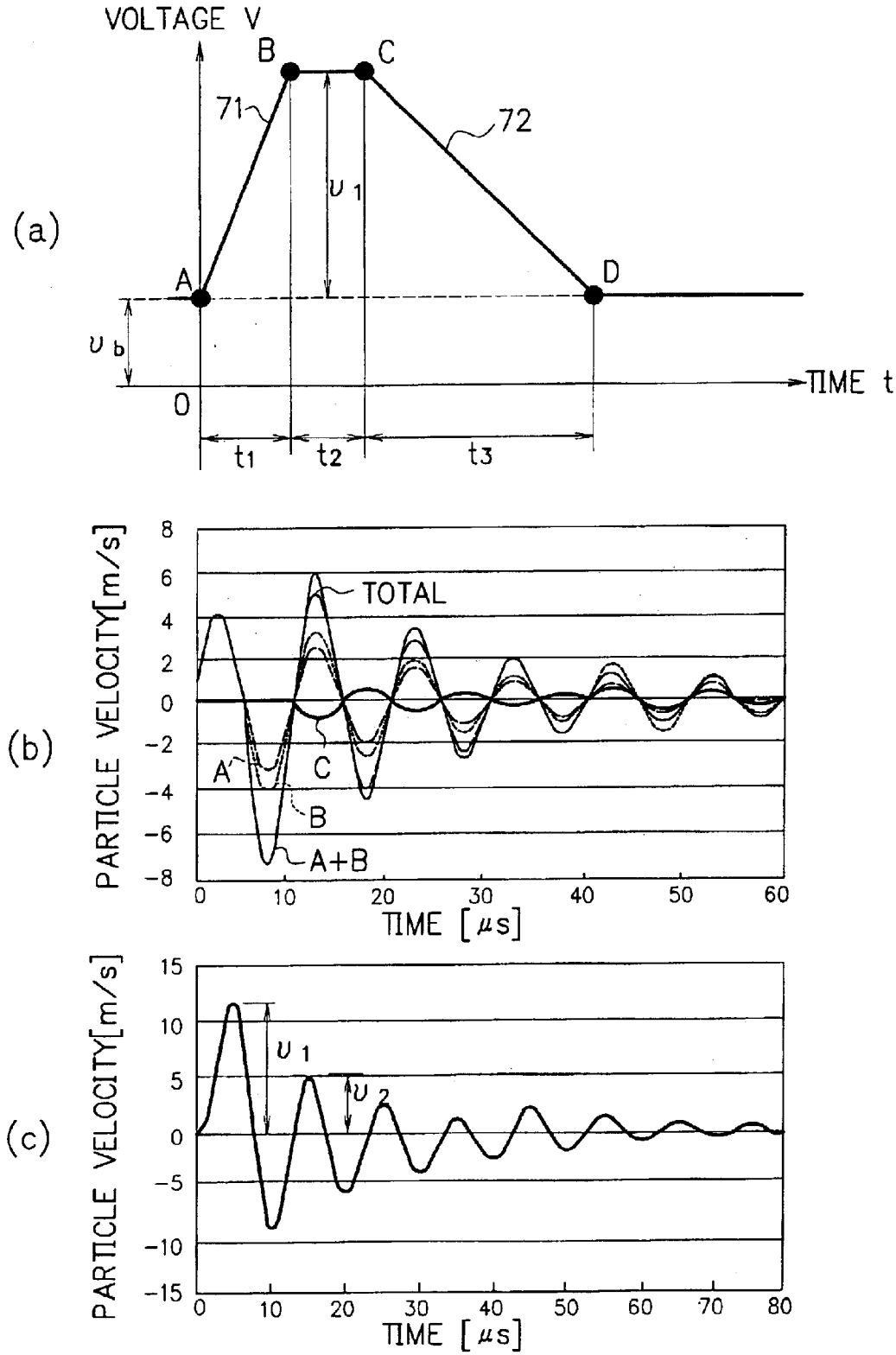
FIGS. 7(*a*), 7(*b*), and 7(*c*) are diagrams showing a driving waveform of the ink jet recording head according to the first embodiment of the present invention.

FIG. 7(*a*) is a diagram showing the driving waveform of the first embodiment used for discharging an ink droplet of about 35 μm in diameter employing the ink jet recording head described above.

The driving waveform in the first embodiment of the present invention comprises a first voltage changing process 71 for compressing the pressure generating chamber at $t_1$=5 μs, and a second voltage changing process 72 for expanding the volume of the pressure generating chamber at fall time $t_3$=30 μs. A time interval ($t_2$) between the finish time of the first voltage changing process and the start time of the second voltage changing process is set to 5 μs. Voltage variation ($V_1$) and bias voltage ($V_b$) are set to 24V and 10V, respectively.

In addition, FIG. 7(*b*) shows a result of calculation for obtaining the particle velocity generated at each node of the driving waveform based on the equation (1) (taking only vibration elements into consideration). Thin lines in the diagram indicate the particle velocity generated at the respective nodes A, B, C, and D, and a bold line indicates the particle velocity of them put together.

Besides, FIG. 7(*c*) shows a result of observing the movement of the ink meniscus in the process of ejection by a microscopic laser Doppler displacement gauge. Incidentally, the observation was performed setting the voltage $V_1$ to 1/10(=2.4V) to observe the movement of the ink meniscus precisely (the result in FIG. 7(*c*) is illustrated with values where the actually measured particle velocity is decuped). Referring to the observation result of FIG. 7(*c*), a ratio ($v_2/v_1$) between a first peak velocity value v, and a second peak velocity value $v_2$ of the ink is 0.42, and thus meets the condition of the equation (3).

As a result of the ejection observation in a high temperature environment (40□), a room temperature environment (25□) and a low temperature environment (5□) using the driving waveform of the first embodiment in accordance with the present invention, stable discharges as shown in FIG. 13(*a*) were observed at all the temperature, and it was confirmed that no fine satellite or low speed satellite was generated. Moreover, the refill time was 42 μs, and the stable discharge was possible until a driving frequency became up to 25 kHz.

As a comparative example, the observation of the particle velocity and ejection was implemented adopting a waveform in which the value of $t_3$ was replaced to 5 μs. As a result, the particle velocity was almost equal to the waveform of a theoretical calculating result as seen in FIG. 3(*c*), and the condition of the equation (3) was not satisfied because $v_2/V_1$=0.22. Therefore, in the low temperature environment (50), the tail of the drop became extremely long as shown in FIG. 13(*c*), and it was confirmed that the tip of the tail flew as the low speed satellite. Furthermore, the refill time was prolonged to 52 μs and the upper limit of the driving frequency for executing the stable ejection dropped to 19 kHz.

As another comparative example, the observation of the particle velocity and ejection was implemented adopting a waveform where $t_2$=10 □, and $t_3$=12 μs. In this case, the particle velocity was almost equal to the waveform of FIG. 4(*c*), and the condition of the equation (3) was not satisfied because $v_2/v_1$=0.63. Therefore, in the high temperature environment (40□), the fine particulate satellite was generated as shown in FIG. 13(*b*), and it was confirmed that, if the ejection was continued for long time, the fine satellite stuck onto the nozzle aperture portion, causing a harmful influence such as an ejection failure and deterioration in an ejecting direction. In an image recording evaluation, it was also confirmed that the rate of occurrence of an ejection defect in the nozzle increased and image quality was liable to be deteriorated. Besides, by the present waveform, although the refill time was 36 μs, which was the shortest, the movement of the meniscus during the refill operation was so intense that the ejection of the ink droplet became unstable in the high temperature environment.

As described above, it was verified that a flying condition of the satellite could be normalized in a wide range of the temperature and also the refill could be accelerated by setting applying timing and the voltage changing time of the second voltage changing process so as to meet the condition of the equation (3).

Incidentally, it is desirable that the voltage changing time t, of the first voltage process is set to approximately ½ of a pressure wave resonance period $T_c$. This is because, when setting $t_1$<½ $T_c$, while the particle velocity generated at the node A of the driving waveform is positive, the negative particle velocity is generated at the node B, thereby the movement of the meniscus in the discharge process becoming liable to be unstable, and thus problems such as deterioration of an ejection characteristic, particularly in the high temperature environment, occur easily. Besides, if t, is prolonged so as to be equal to $T_c$, the residual oscillation enough for a satellite process or speeding up the refill is not to be created.

Moreover, it is desirable that the interval $t_2$ between the first voltage changing process and second voltage changing process is also set to approximately ½ of the pressure wave resonance period $T_c$. That is, all phase s of the particle velocity generated at the nodes A, B and C coincide with each other by setting $t_1$ and $t_2$ to approximately ½ of $T_c$ (refer to FIG. 7(*b*)), and thereby big differences are not easily made in an ejecting condition, even when the resonance frequencies vary among the nozzles due to manufacturing variance.

Furthermore, it is desirable that the voltage changing time $t_3$ of the second voltage changing process is set to ½ or more than ½ of the pressure wave resonance period $T_c$. When $t_3$<½ $T_c$, the movement of the meniscus becomes liable to be unstable on the occasion of controlling the residual oscillation and susceptible to variation in the resonance frequencies.

Incidentally, in the case of implementing a drop diameter modulation recording with the present driving waveform, in the driving circuit as shown in FIG. 6, the present driving waveform is generated by the waveform generating circuit 61, and driving waveforms that correspond to other drop diameters are generated by the waveform generating circuits 61' and 61".

□Second Embodiment□

Figure 8:
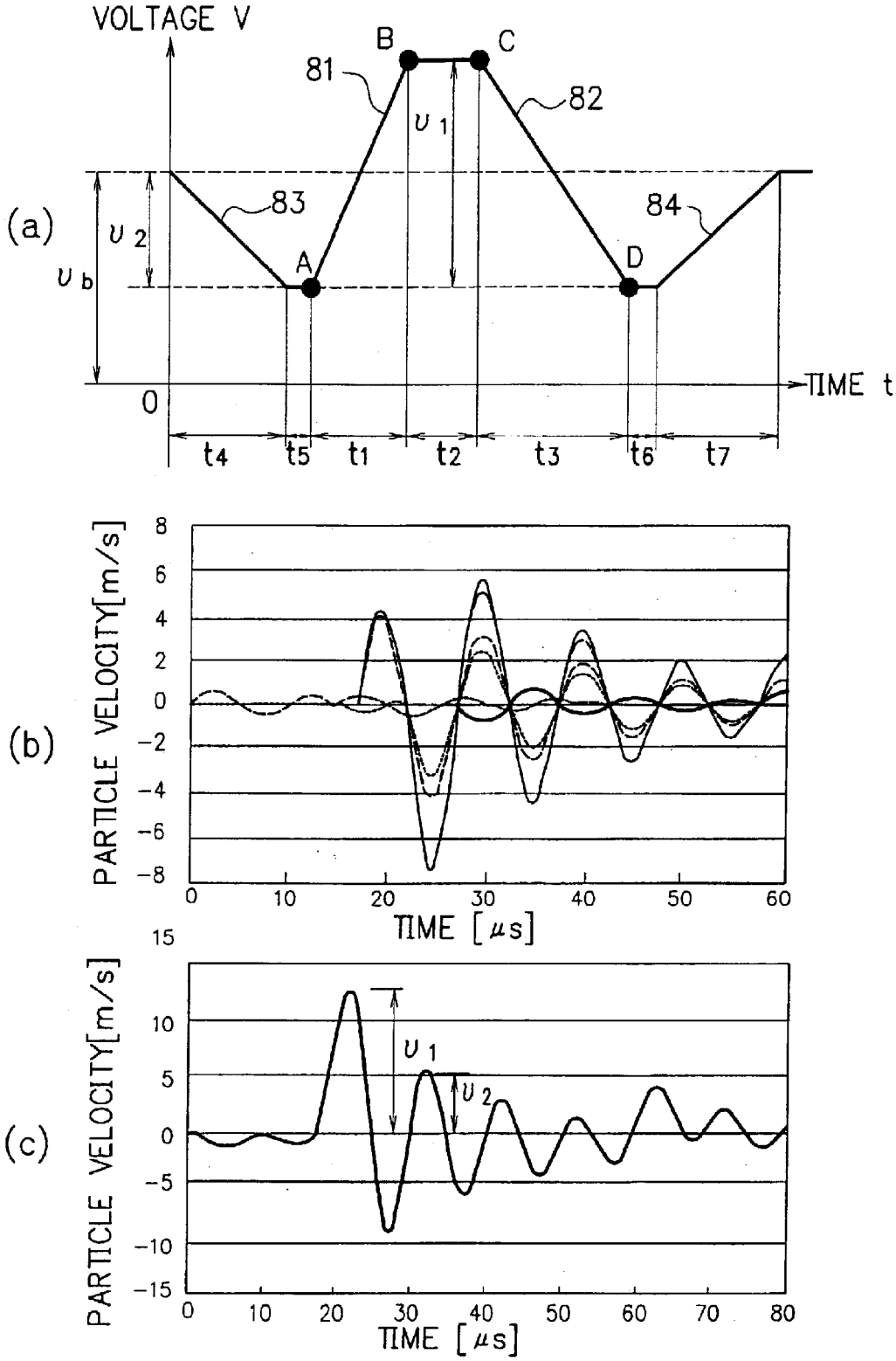
FIGS. 8(*a*), 8(*b*), and 8(*c*) are diagrams showing a driving waveform of the ink jet recording head according to the second embodiment of the present invention.

FIG. 8(*a*) is a diagram showing the driving waveform of the second embodiment used for discharging an ink droplet of about 35 μm in diameter employing the ink jet recording head described above.

The driving waveform in the second embodiment of the present invention comprises a first voltage changing process 81 for compressing the pressure generating chamber at $t_1$=5 μs, a second voltage changing process 82 for expanding the volume of the pressure generating chamber at fall time $t_3$=30 μs, a third voltage changing process 83 for gradually changing applied voltage from bias voltage ($V_b$) before the ejection, and a fourth voltage changing process 84 for gradually returning the applied voltage to the bias voltage after the ejection. A time interval ($t_2$) between the finish time of the first voltage changing process and the start time of the second voltage changing process is set to 5 μs. Voltage variation $V_1$ a bias voltage ($V_b$) and $V_2$ are set to 25V, 20V and 10V, respectively.

FIGS. 8(*b*) and 8(*c*) show a result of observing the movement of a meniscus in the process of the ejection by a microscopic laser Doppler displacement gauge. A ratio $v_2/v_1$ between a first peak value v, and a second peak value $v_2$ is 0.41, which meets the condition of the equation (3). As shown in FIG. 8(*c*), in the third and fourth voltage changing processes, the voltage change is small and affects a particle velocity waveform little. Consequently, the particle velocity waveform, which is almost equal to the driving waveform in the first embodiment, can be obtained.

As a result of the ejection observation in a high temperature environment (40□), a room temperature environment (25□) and a low temperature environment (5□) using the driving waveform of the second embodiment in accordance with the present invention, stable discharges as shown in FIG. 13(*a*) were observed at all the temperature, and it was confirmed that no fine satellite or low speed satellite was generated. In addition, the refill time was 41 μs, and the stable discharge was performed until a driving frequency became up to 25 kHz.

As the second embodiment of the present invention, it is possible to maintain the effect of the present invention, even other voltage changing processes are added to the driving waveform, by setting applying timing, voltage changing time and voltage variation of the second voltage changing process so as to meet the condition of the equation (3).

Figure 9:
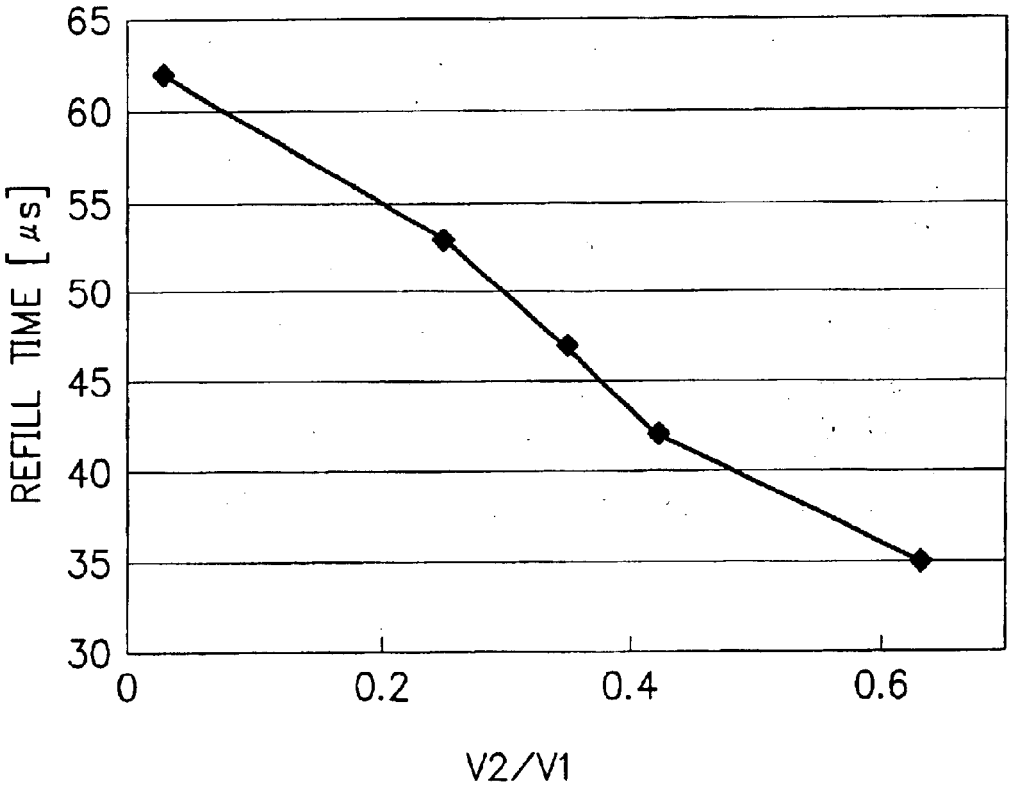
FIG. 9 is a diagram showing a change in refill time according to the driving waveform.

FIG. 9 shows a result of examining the change in refill time (the time which meniscus takes to return to an aperture of the nozzle by a refill movement) when the applying timing and voltage variation of the second voltage changing process 82 in the driving waveform according to the second embodiment of the present invention are changed. Here, it is observed that as the ratio $v_2/v_1$ between a first peak value v, and a second peak value $v_2$ becomes bigger, the refill is more accelerated. Besides, on condition that $v_2/v_1$>0.6, it is also observed that the diameter and speed of the ink droplet during the successive ejection is liable to be unstable (particularly in the high temperature environment).

□Third Embodiment□

Figure 10:
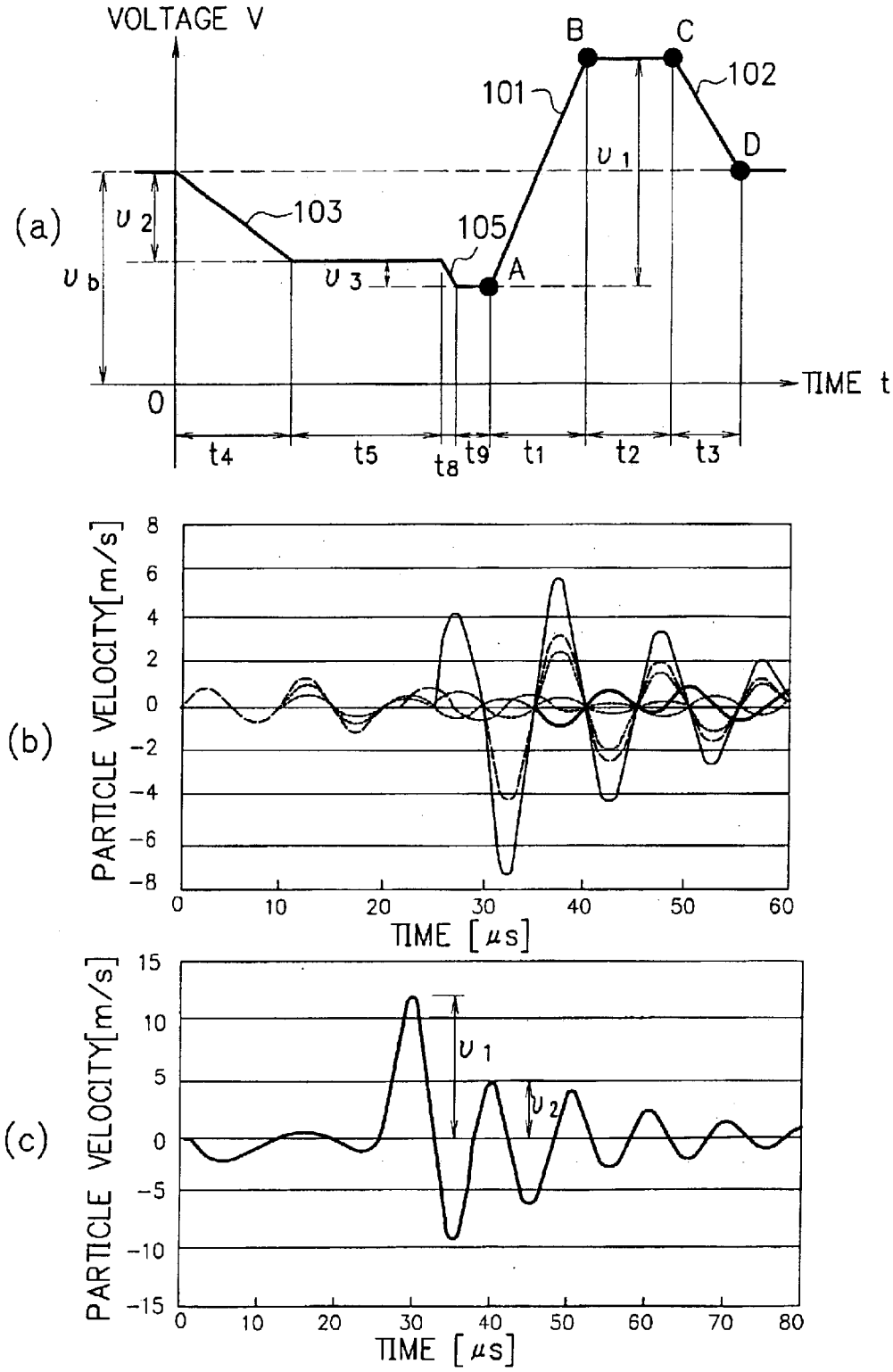
FIGS. 10(*a*), 10(*b*), and 10(*c*) are diagrams showing a driving waveform of the ink jet recording head according to the third embodiment of the present invention.

FIG. 10 is a diagram showing the driving waveform of the third embodiment used for discharging an ink droplet of about 35 μm in diameter with the ink jet recording head described above.

The driving wave form in the third embodiment of the present invention comprises a first voltage changing process

101 for compressing the pressure generating chamber at $t_1$=5 μs, a second voltage changing process 102 for expanding the volume of the pressure generating chamber at fall time $t_3$=12 □, a third voltage changing process 103 for gradually changing applied voltage from bias voltage before the ejection, and a fourth voltage changing process 105 for slightly expanding the pressure generating chamber just before the ejection. A time interval ($t_2$) between the finish time of the first voltage changing process and the start time of the second voltage changing process is set to 5 μs. Voltage variation $V_1$ bias voltage ($V_b$), $V_2$ and $V_3$ are set to 25V, 20V, 8V and 2V respectively.

FIG. 10(*c*) shows a result of observing the movement of a meniscus in the process of the ejection by a microscopic laser Doppler displacement gauge. A ratio $v_2/v_1$ between a first peak value $v_1$ and a second peak value $v_2$ is about 0.42, which meets the condition of the equation (3).

As a result of the ejection observation in a high temperature environment (40□), a room temperature environment (25□) and a low temperature environment (5□) using the driving waveform of the third embodiment in accordance with the present invention, stable discharges as shown in FIG. 13(*a*) were observed at all the temperature, and it was confirmed that no fine satellite or low speed satellite was generated. Moreover, the refill time was 43 μs, and the stable discharge was possible until a driving frequency became up to 25 kHz. Furthermore, the driving waveform of the third embodiment of the present invention proved to be excellent in the stability of an ejecting direction even at the time of high frequency driving or in the high temperature environment, since the meniscus is dragged in just before the ejection.

Incidentally, in the driving waveform of the third embodiment of the present invention, corresponding to the little voltage variation of the second voltage changing process, the voltage changing time $t_3$ of the second voltage changing process is set to a small value so as to meet the condition of the equation (3). Thus the voltage changing time and applying timing of the second voltage changing process cannot be decided simply. It is necessary to set them corresponding to each driving waveform to meet the condition of the equation (3).

While preferred embodiments of the invention have been described above, changes and variations may be made without departing from the spirit or the scope of the present invention. For instance, while the bias voltage (reference voltage) $V_b$ is set so that the voltage applied to the piezoelectric actuator is always positive in the above embodiments, the bias voltage $V_b$ can be set to other voltage such as 0V when it makes no matter to apply negative voltage to the piezoelectric actuator.

Moreover, a piezoelectric actuator in a longitudinal vibration mode using piezoelectric constant $d_{33}$ is employed as the piezoelectric actuator in the above embodiments, however, other actuators such as a longitudinal vibration mode actuator using piezoelectric constant $d_{31}$ may be employed.

Furthermore, while a laminated piezoelectric actuator is employed in the above embodiments, it is possible to obtain the same effect with a single-board-type piezoelectric actuator. The present invention is also applicable to an ink jet recording head utilizing other electromechanical transducer than the piezoelectric actuator, for example, an actuator using electrostatic force or magnetic force.

Furthermore, while a Kyser-type ink jet recording head as shown in FIG. 11 is employed in the above embodiments, the present invention can be similarly applicable to ink jet recording heads having other constitutions such as a recording head in which a groove provided to the piezoelectric actuator is the pressure generating chamber.

Furthermore, an ink jet recording apparatus, which executes the recording of characters or images by discharging colored ink onto recording paper, is employed in the above embodiments, however, the ink jet recording in the present specification is not restricted by the recording of characters and images on the recording paper. That is, the recording medium is not limited to paper, and also liquid to be ejected is not limited to the colored ink. For example, the present invention can be utilized for liquid-drop ejecting apparatuses for industrial purpose such as manufacturing a color filter for display by ejecting colored ink onto a polymer film or glass, or forming a bump for component mounting by ejecting melting solder onto a substrate.

As described above, in accordance with the driving method of the ink jet recording head and ink jet recording apparatus of the present invention, a satellite at the time of ejecting a big droplet can always fly in good condition without regard to a change in environment temperature, and thus it is made possible to remarkably improve quality of a recorded image and reliability of the apparatus.

Moreover, in accordance with the driving method of the ink jet recording head and ink jet recording apparatus of the present invention, refill operation after ejecting a big droplet can be speeded up, thereby a frequency for ejecting an ink droplet increasing, and thus it is made possible to improve recording speed.

What is claimed is:

1. A driving method for an ink jet recording head, including an electromechanical transducer for causing a pressure change in a pressure generating chamber filled with ink so that an ink droplet is discharged from a nozzle connected to the pressure generating chamber, said method comprising:

applying to the transducer a voltage having a waveform comprising a first voltage change for expanding the transducer to compress the volume of the pressure generating chamber, so as to discharge an ink droplet from the nozzle, and a second voltage change for compressing the transducer to expand the volume of the pressure generating chamber, wherein a start time, a voltage changing time, and a voltage variation of the second voltage change are set so that a first peak value $v_1$ and a second peak value $V_2$ of particle velocity of ink in the nozzle satisfy the condition $0.3 \leqq v_2/v_1 \leqq 0.6$, and wherein a time interval between a finish time of the first voltage change and the start time of the second voltage change is approximately one-half the resonance period of a pressure wave generated in the pressure generating chamber.

2. The driving method for an ink jet recording head as claimed in claim 1, wherein a voltage changing time of the first voltage change is approximately one-half the resonance period of the pressure wave generated in the pressure generating chamber.

3. The driving method for an ink jet recording head as claimed in claim 2, wherein the voltage changing time of the second voltage change is at least one-half the resonance period of the pressure wave generated in the pressure generating chamber.

4. The driving method for an ink jet recording head as claimed in claim 1, wherein a voltage changing time of the second voltage change is at least one-half the resonance period of the pressure wave generated in the pressure generating chamber.

5. An ink jet recording apparatus for recording characters and images, said apparatus comprising:

a pressure generating chamber including ink;

a nozzle connected to the pressure generating chamber;

an electromechanical transducer responsive to application of a driving voltage thereto for producing a pressure change in the pressure generating chamber to cause an ink droplet to be discharged from the nozzle; and a waveform generating circuit for applying to the transducer a driving voltage having a waveform comprising a first voltage change for expanding the transducer to compress the volume of th pressure generating chamber, so as to discharge an ink droplet from the nozzle and a second voltage change for compressing the transducer to expand the volume of the pressure generating chamber, wherein a start time, a voltage changing time, and a voltage variation of the second voltage change are set so that a first peak value $v_1$ and a second peak value $v_2$ of particle velocity of the ink in the nozzle satisfy the condition $0.3 \leqq v_2/v_1 \leqq 0.6$, and wherein a time interval between a finish time of the first voltage change and the start time of the second voltage change is approximately one half the resonance period of a pressure wave generated in the pressure generating chamber.

6. The ink jet recording apparatus as claimed in claim 5, wherein a voltage changing time of the first voltage change is approximately one-half resonance period of the pressure wave generated in the pressure generating chamber.

7. The ink jet recording apparatus as claimed in claim 6, wherein a voltage changing time of the second voltage change is at least one-half the resonance period of the pressure wave generated in the pressure generating chamber.

8. The inkjet recording apparatus as claimed in claim 6, wherein the electromechanical transducer a comprises a piezoelectric vibrator.

9. The ink jet recording apparatus as claimed in claim 5, wherein the voltage changing time of the second voltage change is at least one-half the resonance period of the pressure wave generated in the pressure generating chamber.

10. The ink jet recording apparatus as claimed in claim 9, wherein the electromechanical transducer comprises a piezoelectric vibrator.

11. The ink jet recording apparatus as claimed in claim 5, wherein the electromechanical transducer comprises a piezoelectric vibrator.

12. A driving method for an inkjet recording head, including an electromechanical transducer for causing a pressure change in a pressure generating chamber filled with ink so that an ink droplet is discharged from a nozzle connected to the pressure generating chamber said method comprising:

applying to the transducer a voltage having a waveform comprising a first voltage change for expanding the transducer to compress the volume of the pressure generating chamber, so as to discharge an ink droplet from the nozzle, and a second voltage chance for compressing the transducer to expand the volume of the pressure generating chamber, wherein a time interval between a finish time of the first voltage change and the start time of the second voltage change is approximately one-half the resonance period of a pressure wave generated in the pressure generating chamber.

13. A driving method for an ink, jet recording head, including an electromechanical transducer for causing a pressure change in a pressure generating chamber filled with ink so that an ink droplet is discharged from a nozzle connected to the pressure generating chamber, said method comprising:

applying to the transducer a voltage having a waveform comprising a first voltage change for expanding the transducer to compress the volume of the pressure generating chamber, so as to discharge an ink droplet from the nozzle, and a second voltage change for compressing the transducer to expand the volume of the pressure generating chamber, the compression and expansion of the pressure generating chamber causing a waveform in the ink within the pressure generating chamber, wherein a time interval between a finish time of the first voltage change and the start time of the second voltage change is approximately one-half the resonance period of a pressure wave generated in the pressure generating chamber.

14. An ink jet recording apparatus for recording characters and images, said apparatus comprising:

a pressure generating chamber including ink;

a nozzle connected to the pressure generating chamber;

an electromechanical transducer responsive to application of a driving voltage thereto for producing a pressure change in the pressure generating chamber to cause an ink droplet to be discharged from the nozzle; and a waveform generating circuit for applying to the transducer a driving voltage having a waveform comprising a first voltage change for expanding the transducer to compress the volume of the pressure generating chamber, so as to discharge an ink droplet from the nozzle, and a second voltage change for compressing the transducer to expand the volume of the pressure generating chamber, the compression and expansion of the pressure generating chamber causing a waveform in the ink within the pressure generating chamber, wherein a time interval between a finish time of the first voltage change and the start time of the second voltage change is approximately one-half the resonance period of a pressure wave generated in the pressure generating chamber.

* * * * *